US009888801B2

(12) United States Patent
Grewal

(10) Patent No.: US 9,888,801 B2
(45) Date of Patent: Feb. 13, 2018

(54) FOOT ENTRY-ASSISTING TOPSIDE SHOE TAB

(71) Applicant: Tapeshwar S Grewal, Santa Clara, CA (US)

(72) Inventor: Tapeshwar S Grewal, Santa Clara, CA (US)

( * ) Notice: Subject to any disclaimer, the term of this patent is extended or adjusted under 35 U.S.C. 154(b) by 19 days.

(21) Appl. No.: 15/089,544

(22) Filed: Apr. 2, 2016

(65) Prior Publication Data

US 2017/0280906 A1 Oct. 5, 2017

(51) Int. Cl.
*A47G 25/80* (2006.01)
*A47G 25/82* (2006.01)

(52) U.S. Cl.
CPC ..... *A47G 25/80* (2013.01); *A47G 25/82* (2013.01)

(58) Field of Classification Search
CPC ..... A47G 25/80; A47G 25/82; A47G 25/84; A47G 25/90; A47G 25/905; A47G 25/907; A47G 25/908
USPC ..... D2/978, 641, 642
See application file for complete search history.

(56) References Cited

U.S. PATENT DOCUMENTS 631,595 A * 8/1899 Stevenson ..... A47G 25/80 223/113
3,088,639 A * 5/1963 Sexton ..... A47G 25/82 223/118
3,401,856 A * 9/1968 Berlin ..... A47G 25/905 223/111
4,608,769 A * 9/1986 Sturlaugson ..... A43B 11/00 36/138
5,909,831 A * 6/1999 Griffin ..... C07C 17/206 223/111
2002/0008124 A1* 1/2002 Runge ..... A43B 11/02 223/119
2012/0211532 A1* 8/2012 Santos ..... A47G 25/82 223/118

FOREIGN PATENT DOCUMENTS

DE 202014008982 U1 * 6/2015
JP 2006141944 A * 6/2006
JP 2011092668 * 5/2011
JP 2016137221 A * 8/2016

* cited by examiner

*Primary Examiner* — Ismael Izaguirre
(74) *Attorney, Agent, or Firm* — Invent Capture, LLC.; Samuel S. Cho

(57) ABSTRACT

A foot entry-assisting topside shoe tab improves a shoe wearer's foot entry by reducing uncomfortable friction between a shoe tongue and a dorsum of the shoe wearer's foot. In one embodiment, the foot entry-assisting topside shoe tab incorporates a shoe cup insert, a hinge attached to one side of the shoe cup insert, a hinge pivot that allows the shoe cup insert and the hinge to swing around the hinge pivot, and a pull string located near one end of the hinge pivot. In another embodiment, the foot entry-assisting topside shoe tab incorporates a shoe cup insert, a first hole, a second hole, and a looped pull string that loops around the first hole and the second hole. The foot entry-assisting topside shoe tab is side-insensitive and is nearly frictionless at a bottom side of the shoe tongue that otherwise rubs uncomfortably against the dorsum of a shoe wearer's foot.

9 Claims, 5 Drawing Sheets

200

100

200

300

400

500

FOOT ENTRY-ASSISTING TOPSIDE SHOE TAB

BACKGROUND OF THE INVENTION

The present invention generally relates to a foot entry-assisting apparatus. More specifically, the present invention relates to various embodiments of foot entry-assisting topside shoe tabs.

Various shoe designs in the market today are often uncomfortable or inconvenient for initially placing a shoe wearer's foot into an appropriate position inside the shoe. Thus, it is common for a typical shoe wearer to rely on a conventional shoe horn to reduce foot placement friction while temporarily providing a heel area support, as the typical shoe wearer slides his or her foot into the shoe.

However, conventional shoe horn designs in the market today do not address uncomfortable friction that can occur between a shoe tongue and a topside of a wearer's foot. This uncomfortable friction may be especially pronounced if the shoe tongue is made of hard leather or rigid materials.

Therefore, it may be desirable to provide a novel apparatus that assists a shoe wearer's foot entry by reducing uncomfortable friction between a shoe tongue and a topside of the shoe wearer's foot. Furthermore, it may also be desirable to provide a novel apparatus that smoothly glides the shoe wearer's foot into a comfortable position inside the shoe by providing a near-frictionless support near a bottom side of the shoe tongue. In addition, it may also be desirable to provide a novel foot entry-assisting apparatus that is easily portable, storable, and reusable for various shoe designs, regardless of particular sizes of shoes or shapes.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, a foot entry-assisting topside shoe tab is disclosed. This apparatus comprises: a shoe cup insert made of a flexible material, wherein the shoe cup insert is configured to be flexibly bent to fit into a curvature of a bottom surface of a shoe tongue in a shoe; a hinge attached to a side of the shoe cup insert; a hinge pivot at least partially encapsulated by the hinge, wherein the hinge and the shoe cup are configured to swing around the hinge pivot to allow a side-insensitive fitting of the shoe cup, regardless of the shoe being a left-side shoe or a right-side shoe; and a pull string or a pull tab located on or near the shoe cup insert, wherein the pull string or the pull tab is configured to be pulled by a shoe wearer for removal of the foot entry-assisting topside shoe tab from the shoe.

In another embodiment of the invention, another foot entry-assisting topside shoe tab is disclosed. This apparatus comprises: a shoe cup insert made of a flexible material, wherein the shoe cup insert is configured to be flexibly bent to fit into a curvature of a bottom surface of a shoe tongue in a shoe; a first hole and a second hole located on a surface of the shoe cup insert; and a looped pull string forming a loop through the first hole and the second hole, wherein the looped pull string is configured to be pulled by a shoe wearer for removal of the foot entry-assisting topside shoe tab from the shoe.

DETAILED DESCRIPTION

Figure 1:
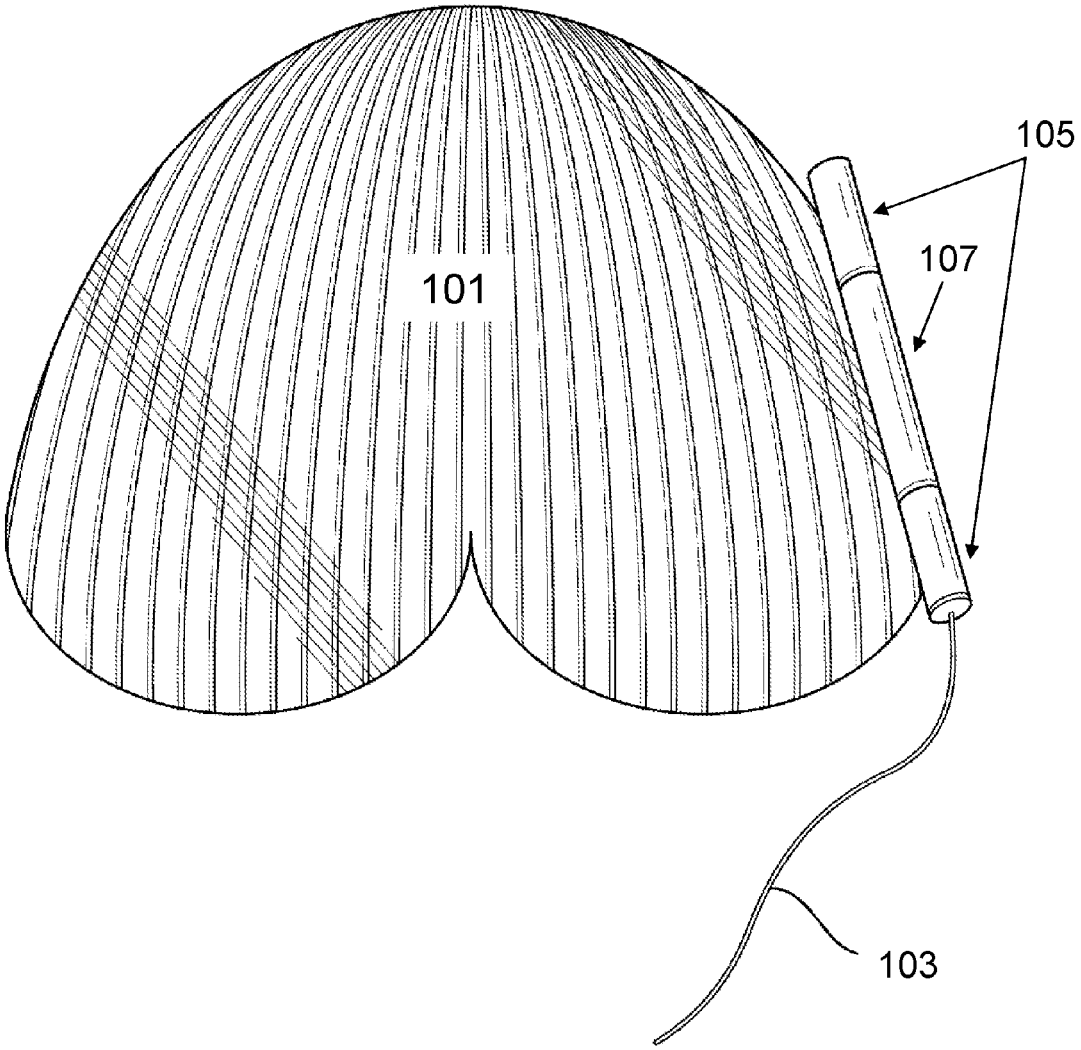
FIG. 1 shows a frontal view of a foot entry-assisting topside shoe tab, in accordance with an embodiment of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The detailed description is presented largely in terms of description of shapes, configurations, and/or other symbolic representations that directly or indirectly resemble one or more novel foot entry-assisting topside shoe tabs, which are configured to be inserted into or pulled out from a shoe. These process descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment. Furthermore, separate or alternative embodiments are not necessarily mutually exclusive of other embodiments. Moreover, the order of blocks in process flowcharts or diagrams representing one or more embodiments of the invention do not inherently indicate any particular order and do not imply any limitations in the invention.

One objective of an embodiment of the present invention is to provide a novel foot entry-assisting topside shoe tab that improves a shoe wearer's foot entry by reducing uncomfortable friction between a shoe tongue and a topside of the shoe wearer's foot.

Another objective of an embodiment of the present invention is to provide a novel foot entry-assisting topside shoe tab that smoothly glides the shoe wearer's foot into a comfortable position inside the shoe by providing a near-frictionless support near a bottom side of the shoe tongue.

A further objective of an embodiment of the present invention is to provide a novel foot entry-assisting topside shoe tab, which is easily portable, storable, and reusable for various shoe designs, regardless of particular sizes of shoes or shapes.

For the purpose of describing the invention, a term, "shoe tab," is defined as a foot entry-assisting apparatus that incorporates a shoe cup insert and at least one of a pull string, a pull tab, and a looped pull string, wherein the shoe cup insert is placed near a bottom surface of a shoe tongue to reduce discomfort and friction between a shoe wearer's foot entering into the shoe and the shoe tongue.

Furthermore, for the purpose of describing the invention, a term, "shoe," is defined as a footwear, which may be a dress shoe, a casual shoe, an athletic shoe, a sandal, a boot, or another type of footwear for men or women.

In addition, for the purpose of describing the invention, a term, "shoe tongue," is defined as a top center portion of a shoe that contacts and contains a dorsum (i.e. upper surface) of a shoe wearer's foot. In one embodiment, a shoe tongue may be a strip of leather, leatherette, or another material underneath or near shoe laces. In another embodiment, a shoe tongue may instead be a rigid top center surface of a shoe, which may or may not have shoe laces.

FIG. 1 shows a frontal view (100) of a foot entry-assisting topside shoe tab, in accordance with an embodiment of the invention. As shown by the frontal view (100) in this embodiment of the invention, the foot entry-assisting topside shoe tab comprises a shoe cup insert (101), a hinge (107) attached to one side of the shoe cup insert (101), a hinge pivot (105) that enables the shoe cup insert (101) and the hinge (107) to swing around the hinge pivot (105), and a pull string (103) located near one end of the hinge pivot (105).

Figure 2:
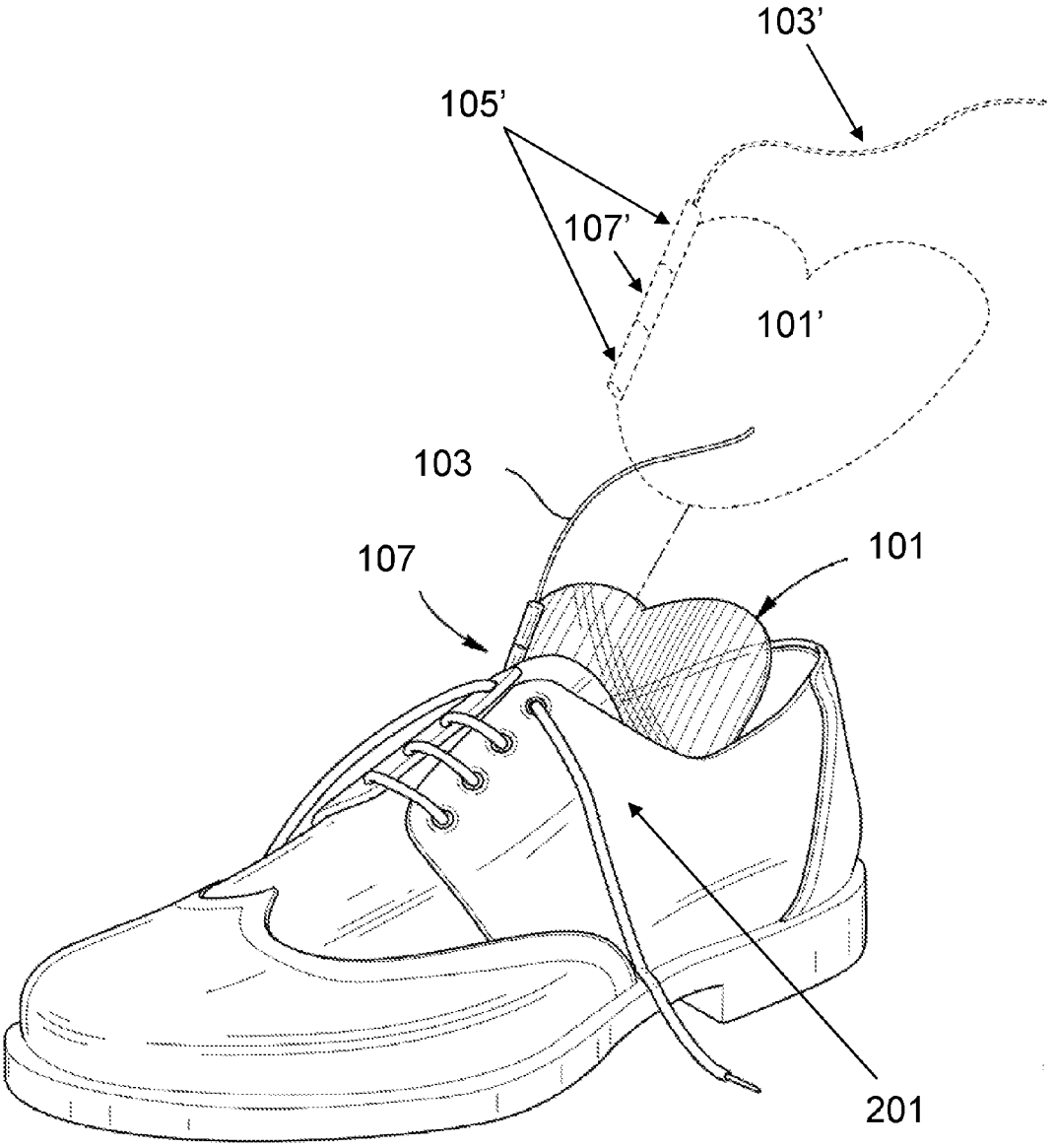
FIG. 2 shows a perspective view of a foot entry-assisting topside shoe tab, which is inserted into an upper portion of a shoe, in accordance with an embodiment of the invention.

In a preferred embodiment of the invention, the shoe cup insert (101) is made of flexible materials, such as flexible plastics or cardboards, in order to ensure a seamless curved fitting inside a shoe near a shoe tongue, as illustrated in FIG. 2. The flexible materials also preferably exhibit low friction coefficients to accommodate smooth glide-in of a shoe wearer's foot and to minimize friction and discomfort between the shoe tongue and the dorsum of the shoe wearer's foot.

Furthermore, as shown by the frontal view (100) in FIG. 1, the foot entry-assisting topside shoe tab incorporates the hinge pivot (105) and the hinge (107), which are configured to be swingable around an axis of rotation provided by the hinge pivot (105). By allowing the shoe cup insert (101) to "swing around" the hinge pivot (105), the foot entry-assisting topside shoe tab can accommodate both left-side shoes and right-side shoes, without being side-specific to only one side among a pair of shoes. The side-insensitive nature of the foot entry-assisting topside shoe tab, enabled by the hinge pivot (105) and the hinge (107) attached to the shoe cup insert (101), improves manufacturing cost efficiencies while also providing the shoe wearer an added convenience of fitting the foot entry-assisting topside shoe tab in either side of the shoes.

In one embodiment of the invention, the hinge pivot (105) and the hinge (107) are made of metallic materials. In another embodiment of the invention, the hinge pivot (105) and the hinge (107) are made of plastic or other materials that sufficiently support and provide a rotating action to the shoe cup insert (101), when the shoe wearer swings the shoe cup insert (101) around the hinge pivot (105).

Moreover, as shown by the frontal view (100) in FIG. 1, in the preferred embodiment of the invention, the foot entry-assisting topside shoe tab also incorporates the pull string (103), which can be pulled by the shoe wearer for removal of the foot entry-assisting topside shoe tab from the shoe, once the shoe wearer's foot placement inside the shoe is completed. The pull string (103) may be made of cotton or synthetic threads. In an alternate embodiment of the invention, a "pull tab" may be utilized in place of the pull string (103), wherein the pull tab is a thin piece of plastic, rubber, or paper strip attached to the hinge pivot (105), the hinge (107), or the shoe cup insert (101) for removal of the foot entry-assisting topside shoe tab from the shoe, when the shoe wearer's foot placement inside the shoe is completed.

FIG. 2 shows a perspective view (200) of a foot entry-assisting topside shoe tab, which is inserted into an upper portion of a shoe (201), in accordance with an embodiment of the invention. The perspective view (200) in this embodiment of the invention shows the foot entry-assisting topside shoe tab in two stages: a pre-insertion phase and an insertion phase. The pre-insertion phase of the foot entry-assisting topside shoe tab is depicted as perforated lines with primed numerical labels (i.e. 101', 103', 105', 107') in FIG. 2, which correlate to the foot entry-assisting topside shoe tab structure with prime-less numerical labels (i.e. 101, 103, 105, 107) in FIG. 1. Furthermore, the insertion phase of the foot entry-assisting topside shoe tab is shown in FIG. 2 as a solid-line figure with corresponding labels (i.e. 101, 103, 107).

As shown by the perspective view (200) in FIG. 2, the hinge (107) and/or its related structure, such as the hinge pivot (e.g. 105 in FIG. 1), allow the shoe cup insert (101) to be swingable sideways for side-insensitive fitting of both left-side shoes and right-side shoes. The side-insensitive nature of the foot entry-assisting topside shoe tab also improves manufacturing cost efficiencies while providing the shoe wearer an added convenience of fitting the foot entry-assisting topside shoe tab in either side of the shoes.

In a preferred embodiment of the invention, the foot entry-assisting topside shoe tab is configured to be inserted into an inner lining of the shoe (201). As shown in the perspective view (200) in FIG. 2, the shoe cup insert (101) is made of a flexible plastic or another flexible material to provide a curved fit underneath a shoe tongue, which is located in the upper portion of the shoe (201). Once inserted into the inner lining of the shoe (201), the shoe cup insert (101) is configured to provide a stationary and tight fit to accommodate smooth and near-frictionless gliding-in of a shoe wearer's foot.

Moreover, as also shown in the perspective view (200) in FIG. 2, the pull string (103) attached to the hinge (107) of the foot entry-assisting topside shoe tab allows the shoe wearer to remove the foot entry-assisting topside shoe tab after his or her foot is securely placed into the shoe (201). In an alternate embodiment of the invention, the foot entry-assisting topside shoe tab may instead utilize a pull tab in place of the pull string, wherein the pull tab incorporates a thin strip made of plastic, rubber, or another appropriate material. In the alternate embodiment, the pull tab may be positioned as an extension piece originating from the hinge (107) or from a related structure to the hinge (107).

Figure 3:
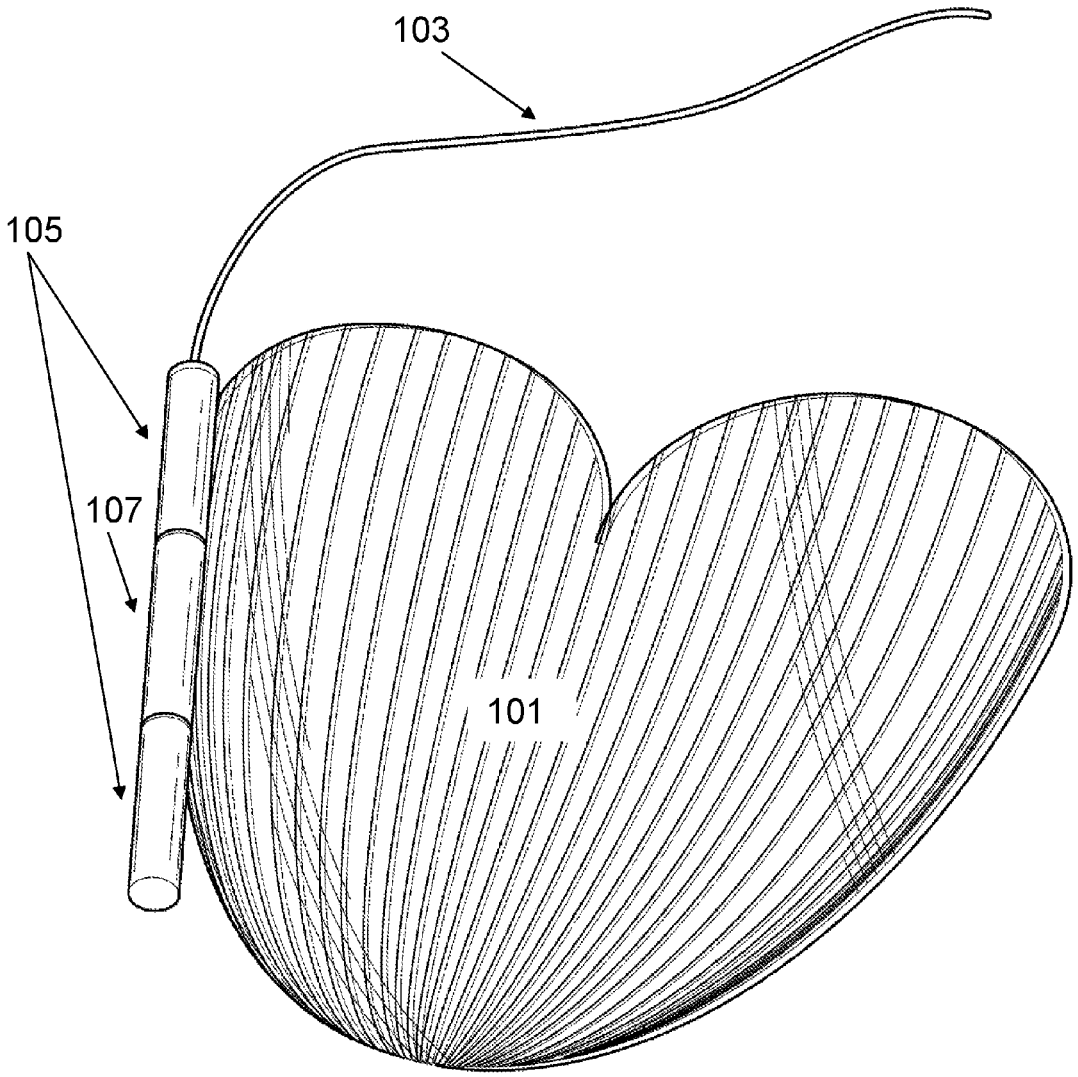
FIG. 3 shows a frontal view of a foot entry-assisting topside shoe tab in the same orientation as the perspective view of FIG. 2 but without the illustration of the shoe, in accordance with an embodiment of the invention.

FIG. 3 shows a frontal view (300) of a foot entry-assisting topside shoe tab in the same orientation as the perspective view of FIG. 2 but without the illustration of the shoe, in accordance with an embodiment of the invention. In this embodiment, the foot entry-assisting topside shoe tab comprises a shoe cup insert (101), a hinge (107) attached to one side of the shoe cup insert (101), a hinge pivot (105) that enables the shoe cup insert (101) and the hinge (107) to swing around the hinge pivot (105), and a pull string (103) located near one end of the hinge pivot (105).

Preferably, the shoe cup insert (101) is made of flexible materials, such as flexible plastics or cardboards, in order to ensure a seamless curved fitting inside a shoe near a shoe tongue, as illustrated in FIG. 2. Typically, the flexible materials have low friction coefficients to accommodate smooth glide-in of a shoe wearer's foot and to minimize friction and discomfort between the shoe tongue and the dorsum of the shoe wearer's foot.

Furthermore, as shown by the frontal view (300) in FIG. 3, the foot entry-assisting topside shoe tab incorporates the hinge pivot (105) and the hinge (107) that enable swinging or rotation of the shoe cup insert (101) around an axis of rotation provided by the hinge pivot (105). By allowing the shoe cup insert (101) to "swing around" the hinge pivot (105), the foot entry-assisting topside shoe tab can accommodate both left-side shoes and right-side shoes, without being side-specific to only one side among a pair of shoes. The side-insensitive nature of the foot entry-assisting topside shoe tab, enabled by the hinge pivot (105) and the hinge (107) attached to the shoe cup insert (101), improves manufacturing cost efficiencies while also providing the shoe wearer an added convenience of fitting the foot entry-assisting topside shoe tab in either side of the shoes.

In one embodiment of the invention, the hinge pivot (105) and the hinge (107) are made of metallic materials. In another embodiment of the invention, the hinge pivot (105) and the hinge (107) are made of plastic or other materials that sufficiently support and provide a rotating action to the shoe cup insert (101), when the shoe wearer swings the shoe cup insert (101) around the hinge pivot (105). Furthermore, as shown by the frontal view (300) in FIG. 3, in the preferred embodiment of the invention, the foot entry-assisting topside shoe tab also incorporates the pull string (103), which can be pulled by the shoe wearer for removal of the foot entry-assisting topside shoe tab from the shoe, once the shoe wearer's foot placement inside the shoe is completed. The pull string (103) may be made of cotton or synthetic threads. In an alternate embodiment of the invention, a "pull tab" may be utilized in place of the pull string (103), wherein the pull tab is a thin piece of plastic, rubber, or paper strip attached to the hinge pivot (105), the hinge (107), or the shoe cup insert (101) for removal of the foot entry-assisting topside shoe tab from the shoe, when the shoe wearer's foot placement inside the shoe is completed.

Figure 4:
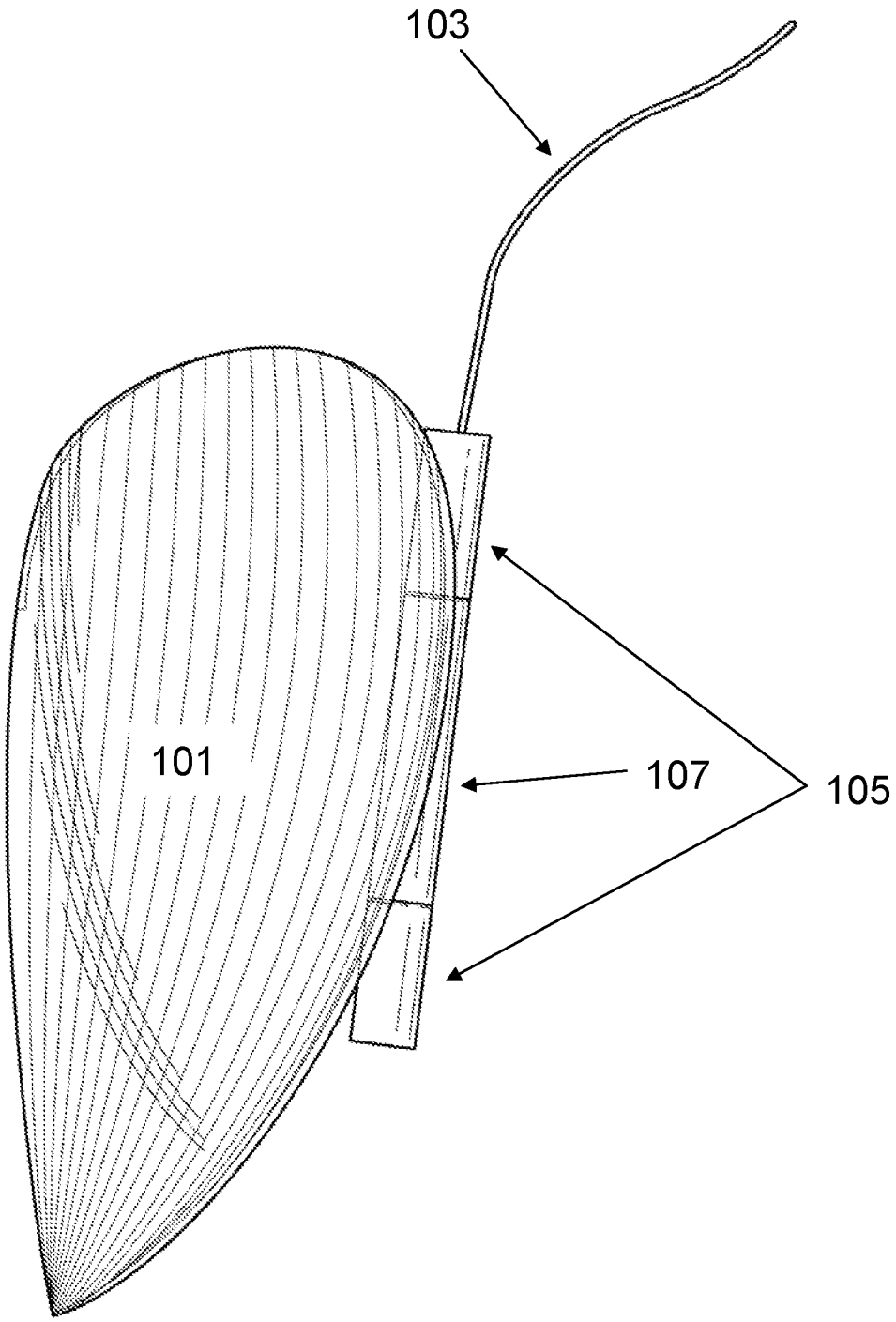
FIG. 4 shows a perspective side view of a foot entry-assisting topside shoe tab, in accordance with an embodiment of the invention.

FIG. 4 shows a perspective side view (400) of a foot entry-assisting topside shoe tab, in accordance with an embodiment of the invention. As shown by this perspective side view (400) in FIG. 4, the shoe cup insert (101) is made of flexible materials to provide an adaptable curved fit relative to the curvature of an inner lining of a shoe. Typically, the curvature of the inner lining correlates to a bottom surface of a shoe tongue or an upper portion of the shoe. The flexible materials also have low friction coefficients to accommodate smooth glide-in of a shoe wearer's foot and to minimize friction and discomfort between the shoe tongue and the dorsum of the shoe wearer's foot.

As shown by the perspective side view (400) in this embodiment of the invention, the foot entry-assisting topside shoe tab comprises a shoe cup insert (101), a hinge (107) attached to one side of the shoe cup insert (101), a hinge pivot (105) that enables the shoe cup insert (101) and the hinge (107) to swing around the hinge pivot (105), and a pull string (103) located near one end of the hinge pivot (105). Furthermore, as shown by the perspective side view (400) in FIG. 4, the foot entry-assisting topside shoe tab incorporates the hinge pivot (105) and the hinge (107), which are configured to be swingable around an axis of rotation provided by the hinge pivot (105).

Moreover, as shown by the perspective side view (400) in FIG. 4, in the preferred embodiment of the invention, the foot entry-assisting topside shoe tab also incorporates the pull string (103), which can be pulled by the shoe wearer for removal of the foot entry-assisting topside shoe tab from the shoe, once the shoe wearer's foot placement inside the shoe is completed. The pull string (103) may be made of cotton or synthetic threads. In an alternate embodiment of the invention, a "pull tab" may be utilized in place of the pull string (103), wherein the pull tab is a thin piece of plastic, rubber, or paper strip attached to the hinge pivot (105), the hinge (107), or the shoe cup insert (101) for removal of the foot entry-assisting topside shoe tab from the shoe, when the shoe wearer's foot placement inside the shoe is completed.

Figure 5:
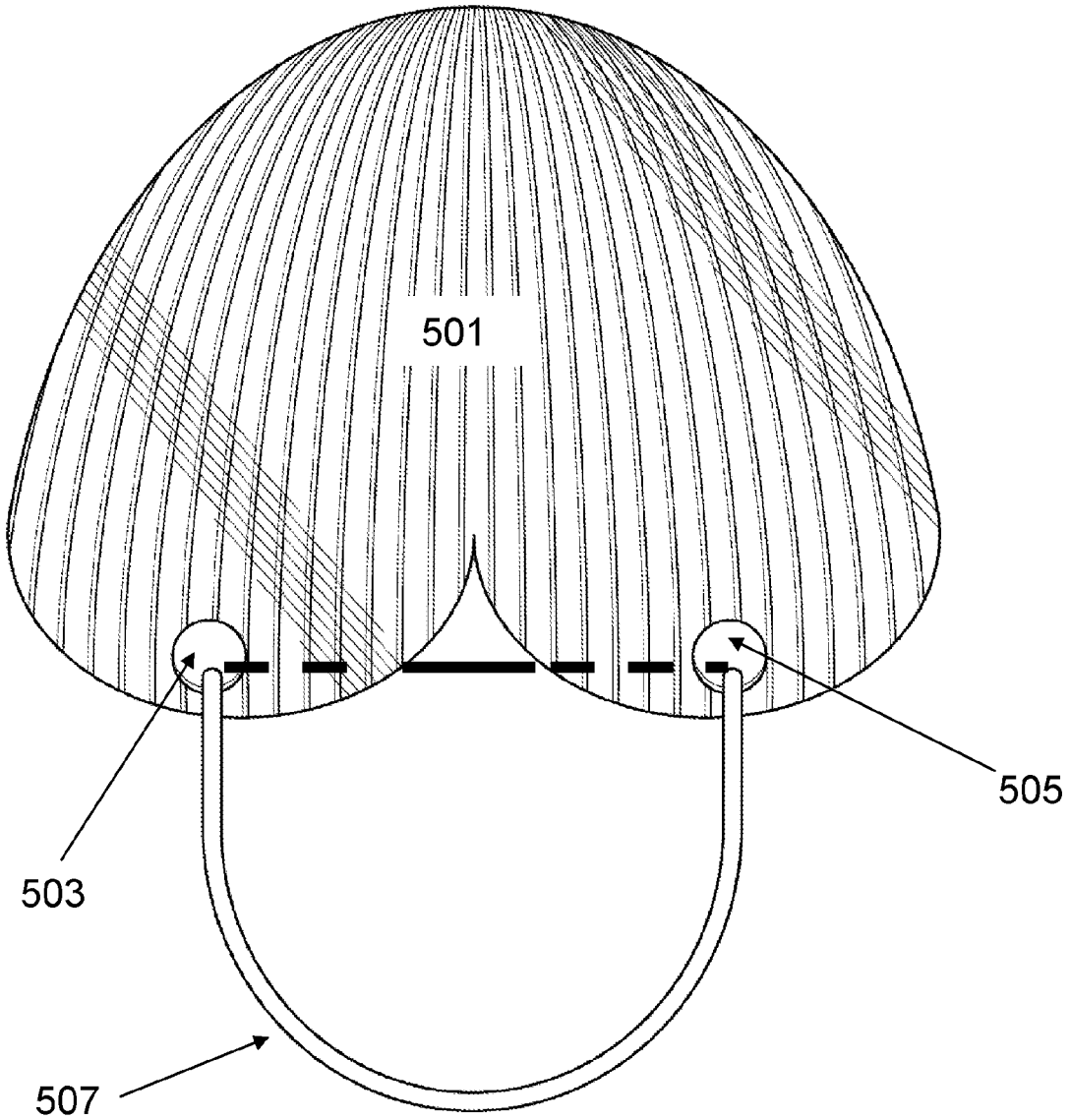
FIG. 5 shows an alternate embodiment of a foot entry-assisting topside shoe tab with a looped string instead of a swingable hinge, in accordance with an embodiment of the invention.

FIG. 5 shows an alternate embodiment (500) of a foot entry-assisting topside shoe tab with a looped pull string (507) instead of a swingable hinge, in accordance with an embodiment of the invention. In this alternate embodiment (500) of the invention, the foot entry-assisting topside shoe tab comprises a shoe cup insert (501), a first hole (503), a second hole (505), and the looped pull string (507), which is looped together through the first hole (503) and the second hole (505). Preferably, the looped pull string is either a one continuous piece of string or a knotted string. The looped pull string (507) may be made of cotton or synthetic threads.

In this alternate embodiment of the invention, the shoe cup insert (501) is made of flexible materials, such as flexible plastics or cardboards, in order to ensure a seamless curved fitting inside a shoe near a shoe tongue. The flexible materials also preferably exhibit low friction coefficients to accommodate smooth glide-in of a shoe wearer's foot and to minimize friction and discomfort between the shoe tongue and the dorsum of the shoe wearer's foot. The looped pull string embodiment of the foot entry-assisting topside shoe tab, as shown in FIG. 5, is preferably side-insensitive, and can fit the curvature of both left-side shoes and right-side shoes.

Moreover, as shown by the alternate embodiment (500) of the invention in FIG. 5, the foot entry-assisting topside shoe tab incorporates the looped pull string (507), which can be pulled by the shoe wearer for removal of the foot entry-assisting topside shoe tab from the shoe, once the shoe wearer's foot placement inside the shoe is completed.

Various embodiments of the present invention, as described above, provide several advantages over utilizing conventional shoe horns. For example, one or more embodiments of the novel foot entry-assisting topside shoe tab improve a shoe wearer's foot entry by reducing uncomfortable friction between a shoe tongue and a topside of the shoe wearer's foot. Furthermore, one or more embodiments of the novel foot entry-assisting topside shoe tab also enable smooth gliding of the shoe wearer's foot into a comfortable position inside the shoe by providing a near-frictionless support near a bottom side of the shoe tongue that otherwise tends to rub uncomfortably against the dorsum of a shoe wearer's foot. Moreover, one or more embodiments of the novel foot entry-assisting topside shoe tab provide an ease of storage, portability, and reusability for various shoe designs, regardless of particular sizes of shoes or shapes.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A foot entry-assisting topside shoe tab comprising:

a shoe cup insert made of a flexible material, wherein the shoe cup insert is flexibly bent and curve-fitting flush and tightly into a curvature of an underside of a shoe tongue in a shoe, wherein a bottom surface of the shoe cup insert provides a smooth gliding surface underneath the shoe tongue for inserting a dorsum of a shoe wearer's foot;

a hinge attached to a side of the shoe cup insert;

a side hinge pivot at least partially encapsulated by the hinge, wherein the hinge and the shoe cup are configured to swing around the side hinge pivot to allow a side-insensitive fitting of the shoe cup, regardless of the shoe being a left-side shoe or a right-side shoe; and a pull string or a pull tab located on or near the shoe cup insert, wherein the pull string or the pull tab is configured to be pulled by a shoe wearer for removal of the foot entry-assisting topside shoe tab from the shoe.

2. The foot entry-assisting topside shoe tab of claim 1, wherein the flexible material is plastic or cardboard that flexibly bends to fit into the curvature of the underside of the shoe tongue when inserted into the shoe.

3. The foot entry-assisting topside shoe tab of claim 1, wherein the hinge and the side hinge pivot are made of metallic, plastic, or rubber materials.

4. The foot entry-assisting topside shoe tab of claim 1, wherein the pull string is made of synthetic or cotton threads.

5. The foot entry-assisting topside shoe tab of claim 1, wherein the pull tab is made from a thin strip of rubber, plastic, or cardboard.

6. The foot entry-assisting topside shoe tab of claim 1, wherein the shoe tongue is a top center portion of the shoe that contacts and contains the dorsum of the shoe wearer's foot, wherein the top center portion is either a surface underneath or near shoe laces or a rigid surface without the shoe laces.

7. A foot entry-assisting topside shoe tab comprising:

a shoe cup insert made of a flexible material, wherein the shoe cup insert is flexibly bent and curve-fitting flush and tightly into a curvature of an underside of a shoe tongue in a shoe, wherein a bottom surface of the shoe cup insert provides a smooth gliding surface underneath the shoe tongue for inserting a dorsum (i.e. upper surface, and not heels) of a shoe wearer's foot;

a first hole and a second hole located near a shoe tongue-protruding edge of the shoe cup insert; and a looped pull string forming a loop through the first hole and the second hole, wherein the looped pull string is configured to be pulled by a shoe wearer for removal of the foot entry-assisting topside shoe tab from the shoe.

8. The foot entry-assisting topside shoe tab of claim 7, wherein the flexible material is plastic or cardboard that flexibly bends to fit into the curvature of the underside of the shoe tongue when inserted into the shoe.

9. The foot entry-assisting topside shoe tab of claim 7, wherein the looped pull string is made of synthetic or cotton threads.

* * * * *